US008807973B2

(12) United States Patent
Park et al.

(10) Patent No.: US 8,807,973 B2
(45) Date of Patent: Aug. 19, 2014

(54) ROTARY-TYPE 2-STAGE COMPRESSOR

(75) Inventors: Joon-hong Park, Changwon-si (KR); Seungjun Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 747 days.

(21) Appl. No.: 13/063,351

(22) PCT Filed: Apr. 7, 2010

(86) PCT No.: PCT/KR2010/002145
§ 371 (c)(1),
(2), (4) Date: Mar. 10, 2011

(87) PCT Pub. No.: WO2010/117214
PCT Pub. Date: Oct. 14, 2010

(65) Prior Publication Data

US 2011/0165004 A1 Jul. 7, 2011

(30) Foreign Application Priority Data

Apr. 9, 2009 (KR) ..... 10-2009-0031015

(51) Int. Cl.
*F04C 11/00* (2006.01)
*F04C 23/00* (2006.01)

(52) U.S. Cl.
USPC ..... 418/11

(58) Field of Classification Search
USPC ..... 418/5, 7, 11
See application file for complete search history.

(56) References Cited

U.S. PATENT DOCUMENTS

2002/0159904 A1 10/2002 Ebara et al.
2008/0236184 A1* 10/2008 Morozumi et al. ..... 62/324.6
2008/0240954 A1* 10/2008 Morozumi et al. ..... 418/13

FOREIGN PATENT DOCUMENTS

JP 05187374 A * 7/1993 ..... F04C 23/02
JP 2006-029085 2/2006
JP 2008-240667 10/2008
JP 2008-248865 10/2008

OTHER PUBLICATIONS

International Search Report issued in PCT/KR2010/002145 dated Nov. 29, 2010.

* cited by examiner

*Primary Examiner* — Mary A Davis
(74) *Attorney, Agent, or Firm* — Ked & Associates, LLP

(57) ABSTRACT

A 2-stage rotary compressor is provided that includes a hermetic container, a rotating shaft provided in the hermetic container to transfer a rotational force, a low pressure compression assembly including a low pressure roller eccentrically rotated around a center of the rotating shaft, a low pressure cylinder that accommodates the low pressure roller, and a low pressure vane that partitions an inner space of the low pressure cylinder, a high pressure compression assembly including a high pressure roller eccentrically rotated around the center of the rotating shaft, a high pressure cylinder that accommodates the high pressure roller, and a high pressure vane that partitions an inner space of the high pressure cylinder, a connection pipe that provides a passage for the refrigerant compressed in the low pressure compression assembly to be introduced into the high pressure compression assembly, and an injection pipe connected to the connection pipe. An inner diameter of a middle portion of the connection pipe is greater than inner diameters of both end portions of the connection pipe.

16 Claims, 7 Drawing Sheets

ROTARY-TYPE 2-STAGE COMPRESSOR

TECHNICAL FIELD

The present invention relates to a 2-stage rotary compressor, and, more particularly, to a 2-stage rotary compressor having an improved connection pipe which guides the mid-pressure refrigerant compressed in a low pressure compression assembly to a high pressure compression assembly.

BACKGROUND ART

In general, a compressor is a mechanical apparatus which receives power from a power generation apparatus, such as a motor, a turbine, or the like, and which compresses the air, refrigerant or various operating gases to raise pressure. The compressor has been widely used for electric home appliances such as refrigerators and air conditioners, and the application thereof has been expanded to the whole industry.

The compressors are roughly classified into a reciprocating compressor in which a compression space into/from which an operating gas is sucked and discharged is defined between a piston and a cylinder and the piston is linearly reciprocated in the cylinder to compress refrigerant, a rotary compressor in which a compression space into/from which an operating gas is sucked and discharged is defined between an eccentrically-rotated roller and a cylinder and the roller is eccentrically rotated along the inside wall of the cylinder to compress refrigerant, and a scroll compressor in which a compression space into/from which an operating gas is sucked and discharged is defined between an orbiting scroll and a fixed scroll and the orbiting scroll is rotated along the fixed scroll to compress refrigerant.

Particularly, the rotary compressor has been developed into a twin rotary compressor including two rollers and two cylinders at its upper and lower portions, wherein the upper and lower roller and cylinder pairs compress some and the rest of the total compression capacity, and a 2-stage rotary compressor including two rollers and two cylinders at its upper and lower portions, wherein the two cylinders communicate with each other, one pair compresses relatively low pressure refrigerant, and the other pair compresses relatively high pressure refrigerant which has been subjected to the low pressure compression.

Korean Registered Patent Publication No. 10-1994-0001355 discloses a rotary compressor. A motor is located in a shell and a rotating shaft is installed to pass through the motor. In addition, a cylinder is located below the motor, and an eccentric portion fitted around the rotating shaft and a roller fitted into the eccentric portion are located in the cylinder. A refrigerant outlet and a refrigerant inlet are formed in the cylinder, and a vane is installed between the refrigerant outlet and the refrigerant inlet so as to prevent non-compressed low pressure refrigerant from being mixed with compressed high pressure refrigerant. Moreover, a spring is installed at one end of the vane so that the eccentrically-rotated roller and the vane can be kept in contact with each other. When the rotating shaft is rotated by the motor, the eccentric portion and the roller are rotated along the inner circumference of the cylinder, compressing a refrigerant gas. The compressed refrigerant gas is discharged through the refrigerant outlet. Korean Laid-Open Patent Publication No. 10-2005-0062995 discloses a twin rotary compressor. Referring to FIG. 1, the twin rotary compressor includes two cylinders 1035 and 1045 compressing the same capacity and a middle plate 1030, and thus doubles a compression capacity as compared with a 1-stage compressor.

Korean Laid-Open Patent Publication No. 10-2007-0009958 discloses a 2-stage rotary compressor. Referring to FIG. 2, a compressor 2001 includes a motor 2014 located in an inside upper portion of a hermetic container 2013 and having a stator 2007 and a rotor 2008, and a rotating shaft 2002 connected to the motor 2014 includes two eccentric portions. A main bearing 2009, a high pressure compression element 2020*b*, a middle plate 2015, a low pressure compression element 2020*a*, and a sub bearing 2019 are successively stacked from the motor unit 2014 side with respect to the rotating shaft 2002. Additionally, a middle pipe 2040 is provided, which introduces the refrigerant compressed in the low pressure compression element 2020*a* into the high pressure compression element 2020*b*.

DISCLOSURE

Technical Problem

An object of the present invention is to provide a 2-stage rotary compressor having a connection pipe which guides the refrigerant compressed in a low pressure compression assembly to a high pressure compression assembly, wherein the respective portions of the connection pipe have different inner diameters according to their roles, thereby ensuring the reliability of the compressor and improving the coefficient of performance (COP) of the compressor.

Technical Solution

According to an aspect of the present invention, there is provided a 2-stage rotary compressor which includes: a hermetic container; a rotating shaft provided in the hermetic container and transferring a rotation force; a low pressure compression assembly including a low pressure roller eccentrically rotated around the center of the rotating shaft, a low pressure cylinder accommodating the low pressure roller, and a low pressure vane partitioning the inner space of the low pressure cylinder; a high pressure compression assembly including a high pressure roller eccentrically rotated around the center of the rotating shaft, a high pressure cylinder accommodating the high pressure roller, and a high pressure vane partitioning the inner space of the high pressure cylinder; a connection pipe providing a passage so that the refrigerant compressed in the low pressure compression assembly can be introduced into the high pressure compression assembly; and an injection pipe connected to the connection pipe, wherein the ratio of the stroke volume V2 of the high pressure cylinder to the stroke volume V1 of the low pressure cylinder satisfies the relational expression of $0.43<V2/V1<0.82$.

According to another aspect of the present invention, there is provided a 2-stage rotary compressor which includes: a hermetic container; a rotating shaft provided in the hermetic container and transferring a rotation force; a low pressure compression assembly including a low pressure roller eccentrically rotated around the center of the rotating shaft, a low pressure cylinder accommodating the low pressure roller, and a low pressure vane partitioning the inner space of the low pressure cylinder; a high pressure compression assembly including a high pressure roller eccentrically rotated around the center of the rotating shaft, a high pressure cylinder accommodating the high pressure roller, and a high pressure vane partitioning the inner space of the high pressure cylinder; a connection pipe providing a passage so that the refrigerant compressed in the low pressure compression assembly can be introduced into the high pressure compression assembly; and an injection pipe connected to the connection pipe, wherein the inner diameter of a middle portion of the connection pipe is greater than the inner diameters of both end portions of the connection pipe.

In addition, the 2-stage rotary compressor further includes a mid-pressure chamber temporarily storing the refrigerant compressed in and discharged from the low pressure compression assembly, one end portion of the connection pipe is connected to the mid-pressure chamber, and the other end portion thereof is connected to the high pressure cylinder. Moreover, the inner diameter Du of the high pressure-side end portion of the connection pipe and the height H of the high pressure cylinder satisfy the relational expression of $0.4<Du/H<0.85$.

Further, the inner diameter of the high pressure-side end portion of the connection pipe is at least 5 mm smaller than the height of the high pressure cylinder.

Furthermore, the mid-pressure chamber is defined in a lower bearing, and the inner diameter Du of the low pressure-side end portion of the connection pipe and the height H of the lower bearing satisfy the relational expression of $0.4<Du/H<0.85$.

Still furthermore, the mid-pressure chamber is defined in a lower bearing, and the inner diameter of the low pressure-side end portion of the connection pipe is at least 5 mm smaller than the height of the lower bearing.

Still furthermore, the low pressure cylinder further includes a refrigerant inlet pipe through which low pressure refrigerant is sucked, and the inner diameter of the refrigerant inlet pipe is about the same as the inner diameter of the low-pressure side end portion of the connection pipe.

Still furthermore, the injection pipe is connected to the middle portion of the connection pipe which has a larger inner diameter than both end portions thereof.

Still furthermore, the injection pipe is connected in closer proximity to the low pressure-side end portion than the high pressure-side end portion. Still furthermore, the rotating shaft includes a low pressure eccentric portion in a position eccentric with respect to the center of the rotating shaft, the low pressure eccentric portion includes a contact portion which is brought into contact with the inner circumferential surface of the low pressure roller and a non-contact portion which is not brought into contact with the inner circumferential surface of the low pressure roller, and the height of the contact portion of the low pressure eccentric portion is equal to or smaller than 70% of the height of the low pressure roller.

Still furthermore, the rotating shaft includes a high pressure eccentric portion in a position eccentric with respect to the center of the rotating shaft, the high pressure eccentric portion includes a contact portion which is brought into contact with the inner circumferential surface of the high pressure roller and a non-contact portion which is not brought into contact with the inner circumferential surface of the high pressure roller, and the height of the contact portion of the high pressure eccentric portion is equal to or greater than 70% of the height of the high pressure roller.

Still furthermore, the mass sum of the low pressure roller and the low pressure eccentric portion is the same as the mass sum of the high pressure roller and the high pressure eccentric portion.

Advantageous Effects

In the 2-stage rotary compressor provided by the present invention, since the low pressure cylinder and the high pressure cylinder have different heights and thus different stroke volumes, it is possible to reduce the over-compression loss to improve the COP.

In the 2-stage rotary compressor provided by the present invention, the inner diameter of the middle portion of the connection pipe which guides the refrigerant compressed in the low pressure compression assembly to the high pressure compression assembly is increased, so that the increased volume of the connection pipe can reduce the pulsation of the refrigerant while the refrigerant is discharged from the low pressure compression assembly and sucked into the high pressure compression assembly.

In the 2-stage rotary compressor provided by the present invention, as the inner diameter of the middle portion of the connection pipe is increased, the inner diameter of the injection pipe connected to the connection pipe can be increased, and thus the amount of the gaseous refrigerant injected through the injection pipe can be increased, thereby improving the COP.

In the 2-stage rotary compressor provided by the present invention, since the inner diameters of both end portions of the connection pipe have a given range ratio with respect to the height of the lower bearing or the high pressure cylinder, it is possible to ensure the reliability of the compressor and improve the performance thereof.

MODE FOR INVENTION

Figure 1:
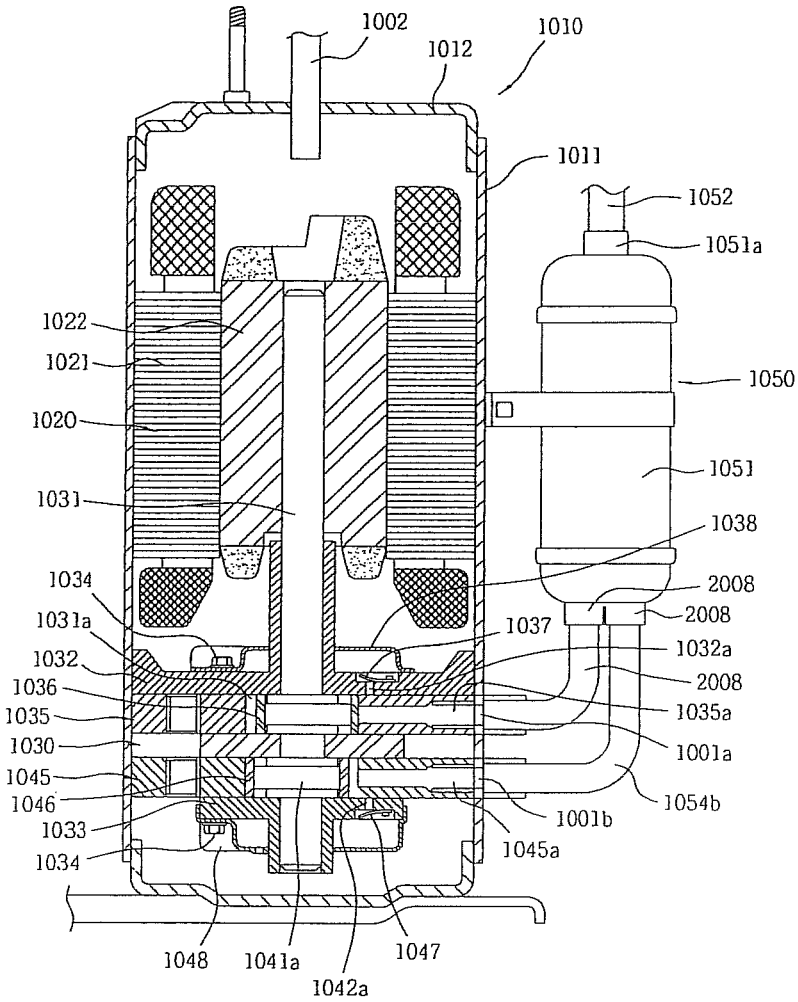
Figure 1 Prior Art
FIG. 1 is a view of an example of a conventional twin rotary compressor.
Figure 2:
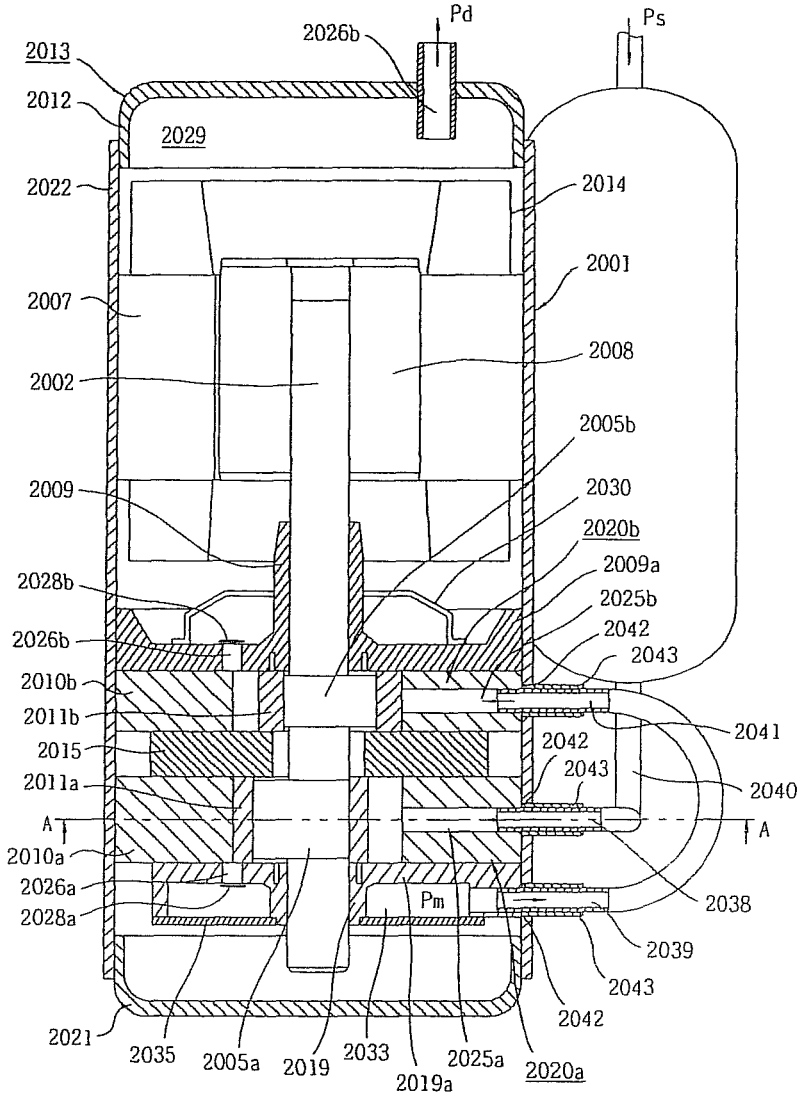
Figure 2 Prior Art
FIG. 2 is a view of an example of a conventional 2-stage rotary compressor.
Figure 3:
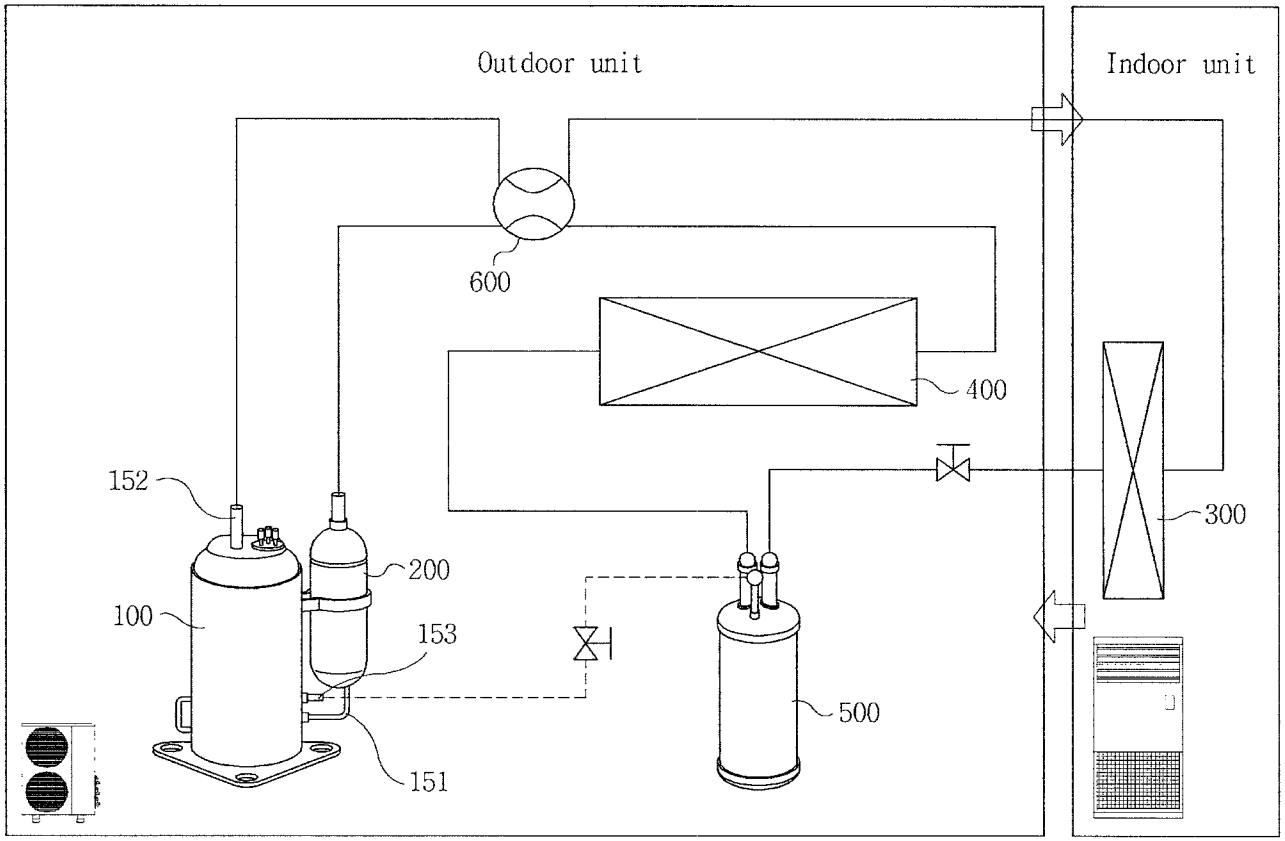
FIG. 3 is a schematic view of an example of a cycle including a 2-stage rotary compressor.

FIG. 3 is a schematic view of an example of a refrigerating cycle including a 2-stage rotary compressor. The refrigerating cycle includes components such as a 2-stage rotary compressor 100, a condenser 300, an evaporator 400, a phase separator 500, and a 4-way valve 600. The condenser 300 constitutes an indoor unit, and the compressor 100, the evaporator 400 and the phase separator 500 constitute an outdoor unit. The refrigerant compressed in the compressor 100 is introduced into the condenser 300 of the indoor unit via the 4-way valve 600, so that the compressed refrigerant gas is condensed, exchanging heat with the ambient air. The condensed refrigerant has a low pressure while passing through an expansion valve. The refrigerant passing through the expansion valve is separated into gas and liquid in the phase separator 500, and the liquid is introduced into the evaporator 400. The liquid is evaporated in the evaporator 400, exchanging heat, introduced into an accumulator 200 in a gas phase, and then transferred from the accumulator 200 to a low pressure compression assembly (not shown) through a refrigerant inlet pipe 151 of the compressor 100. In addition, the gas separated in the phase separator 500 is introduced into the compressor 100 through an injection pipe 153. The mid-pressure refrigerant compressed in the low pressure compression assembly of the compressor 100 and the refrigerant introduced through the injection pipe 153 are introduced into a high pressure compression assembly (not shown) of the compressor 100, compressed to a high pressure, and discharged to the outside of the compressor 100 through a refrigerant outlet pipe 152.

Figure 4:
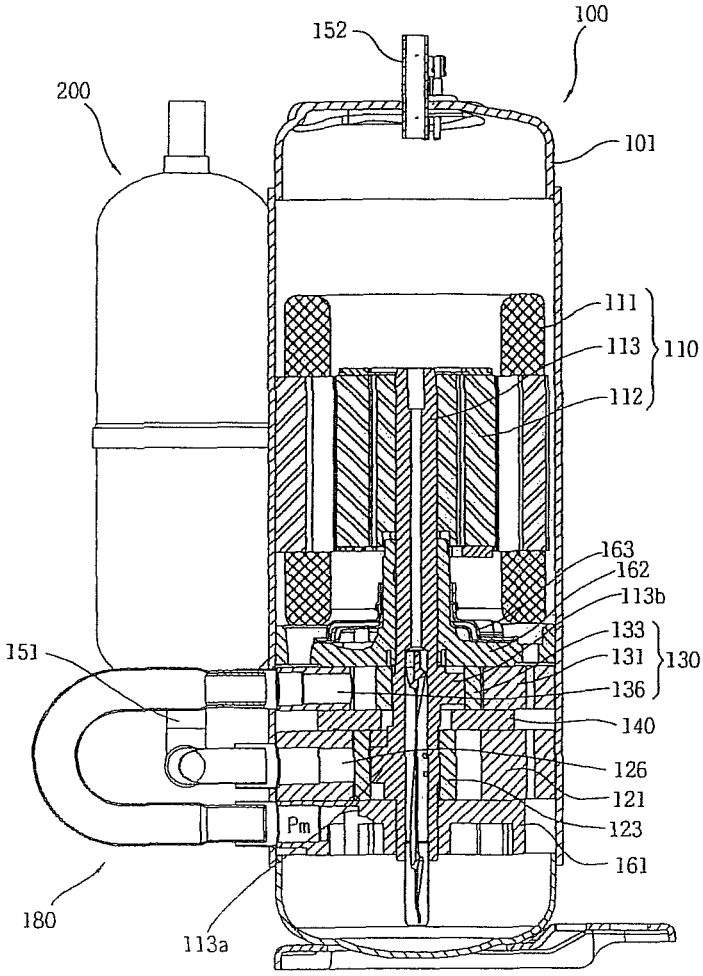
FIG. 4 is a view of a 2-stage rotary compressor according to an embodiment of the present invention.

FIG. 4 is a view of a 2-stage rotary compressor according to an embodiment of the present invention. A 2-stage rotary compressor 100 according to the embodiment of the present invention includes a low pressure compression assembly 120, a middle plate 140, a high pressure compression assembly 130, and a motor 110 in a hermetic container 101 from the bottom. In addition, the 2-stage rotary compressor 100 includes a refrigerant inlet pipe 151 passing through the hermetic container 101 and connected to an accumulator 200, and a refrigerant outlet pipe 152 discharging compressed refrigerant to the outside of the hermetic container 101.

The motor 110 includes a stator 111, a rotor 112, and a rotating shaft 113. The stator 111 has a lamination of annular electronic steel plates and a coil wound around the lamination. The rotor 112 also has a lamination of electronic steel plates. The rotating shaft 113 passes through the center of the rotor 112 and is fixed to the rotor 112. When the current is applied to the motor 110, the rotor 112 is rotated due to a mutual electromagnetic force between the stator 111 and the rotor 112, and the rotating shaft 113 fixed to the rotor 112 is rotated with the rotor 112. The rotating shaft 113 is extended from the rotor 112 near to the bottom surface of the hermetic container 101, passing through the central portions of the low pressure compression assembly 120, the middle plate 140, and the high pressure compression assembly 130.

The low pressure compression assembly 120 and the high pressure compression assembly 130 may be stacked with the middle plate 140 therebetween in the order of the low pressure compression assembly 120, the middle plate 140, and the high pressure compression assembly 130 from the bottom. On the contrary, the low pressure compression assembly 120 and the high pressure compression assembly 130 may be stacked in the order of the high pressure compression assembly 130, the middle plate 140, and the low pressure compression assembly 120 from the bottom. In addition, regardless of the stacking order of the low pressure compression assembly 120, the middle plate 140, and the high pressure compression assembly 130, a lower bearing 161 and an upper bearing 162 are installed at lower and upper portions of the stacked assemblies, respectively, thus facilitating the rotation of the rotating shaft 113 and supporting a load of the respective components of the vertically-stacked 2-stage compression assemblies. The upper bearing 162 is 3-spot-welded to the hermetic container 101, supports the load of the 2-stage compression assemblies, and is fixed to the hermetic container 101.

The refrigerant inlet pipe 151, which passes through the hermetic container 101 from the outside, is connected to the low pressure compression assembly 120. Moreover, the lower bearing 161 is located at a lower portion of the low pressure compression assembly 120. A mid-pressure chamber Pm is defined in the lower bearing 161. The mid-pressure chamber Pm is a space to which the refrigerant compressed in the low pressure compression assembly 120 is discharged and a space in which the refrigerant is temporarily stored before it is introduced into the high pressure compression assembly 130. The mid-pressure chamber Pm serves as a buffering space on the passage through which the refrigerant flows from the low pressure compression assembly 120 to the high pressure compression assembly 130.

The refrigerant compressed in the low pressure compression assembly 120 to reach a mid-pressure is discharged to the mid-pressure chamber Pm defined in the lower bearing 161, and then sucked into the high pressure compression assembly 130 through a connection pipe 180. The refrigerant is secondarily compressed in the high pressure compression assembly 130 to reach a high pressure, and then discharged from the high pressure compression assembly 130. The high pressure refrigerant is discharged to a discharge space between the upper bearing 162 located at an upper portion of the high pressure compression assembly 130 and an discharge cover 163 located at an upper portion of the upper bearing 162, and then discharged to the inside of the hermetic container 101 through an outlet port (not shown) formed in the discharge cover 163. The refrigerant discharged to the inside of the hermetic container 101 through the outlet port (not shown) is discharged to the outside through the refrigerant outlet pipe 152 located at an upper portion of the hermetic container 101.

Figure 5:
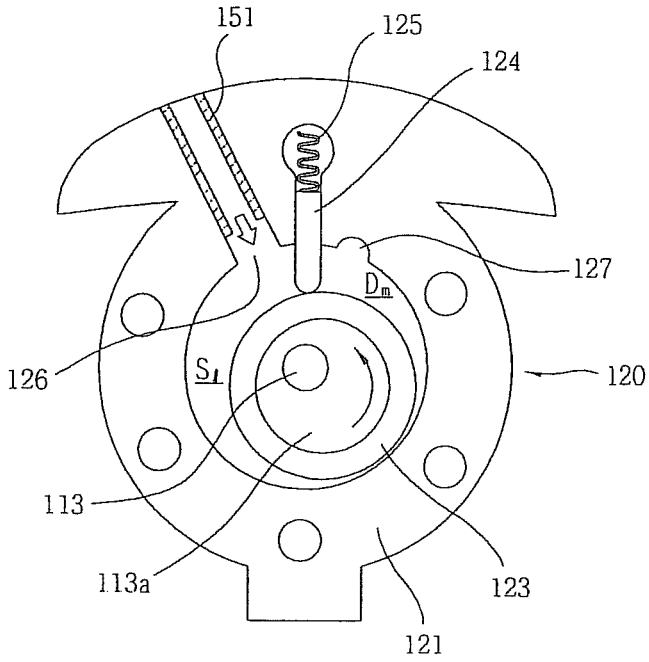
FIG. 5 is a bottom view of a low pressure compression assembly.

FIG. 5 is a bottom view of the low pressure compression assembly. Referring to FIGS. 4 and 5, the low pressure compression assembly 120 includes a low pressure cylinder 121, a low pressure roller 123, a low pressure vane 124, a low pressure elastic member 125, and a low pressure inlet 126. The rotating shaft 113 passes through the central portion of the low pressure cylinder 121, and the low pressure roller 123 is rotatably coupled to a low pressure eccentric portion 113*a* integrally formed with the rotating shaft 113. The low pressure roller 123 is rotated by the rotation of the rotating shaft 113, rolling along the inner circumference of the low pressure cylinder 121. The low pressure inlet 126 and a mid-pressure outlet 127 are formed at both sides of the low pressure vane 124. In addition, the space inside the low pressure cylinder 121 is partitioned off by the low pressure vane 124 and the low pressure roller 123, so that the pre-compression refrigerant and the post-compression refrigerant coexist in the low pressure cylinder 121. In the portions divided by the low pressure vane 124 and the low pressure roller 123, the portion including the low pressure inlet 126 is referred to as a low pressure refrigerant inlet portion $S_1$ and the portion including the mid-pressure outlet 127 is referred to as a mid-pressure refrigerant outlet portion $D_m$. Here, the low pressure elastic member 125 is means for applying a force to the low pressure vane 124 so that the low pressure vane 124 can be kept in contact with the low pressure roller 123. A vane hole 124*h* formed in the low pressure cylinder 121 so that the low pressure vane 124 can be located therein passes through the low pressure cylinder 121 in the horizontal direction. The motion of the low pressure vane 124 is guided through the vane hole 124, and the low pressure elastic member 125 applying a force to the low pressure vane 124 passes through the low pressure cylinder 121 using the vane hole 124 and extends to the hermetic container 101. One end of the low pressure elastic member 125 is brought into contact with the low pressure vane 124 and the other end thereof is brought into contact with the hermetic container 101 to push the low pressure vane 124, so that the low pressure vane 124 can be kept in contact with the low pressure roller 123.

When the low pressure eccentric portion 113*a* is eccentrically rotated around the center of the rotating shaft 113 by the rotation of the rotating shaft 113 and the low pressure roller 123 rolls along the low pressure cylinder 121 due to the rotation of the low pressure eccentric portion 113*a*, the volume of the low pressure refrigerant inlet portion $S_1$ increases, and thus the pressure thereof becomes low, so that the refrigerant is introduced through the low pressure inlet 126. On the contrary, as the volume of the mid-pressure refrigerant outlet portion $D_m$ decreases, the refrigerant filled in the mid-pressure refrigerant outlet portion $D_m$ is compressed, and then discharged through the mid-pressure outlet 127. The volumes of the low pressure refrigerant inlet portion $S_1$ and the mid-pressure refrigerant outlet portion $D_m$ are continuously changed according to the rotation of the low pressure eccentric portion 122 and the low pressure roller 123, such that the compressed refrigerant is discharged in every rotation.

The refrigerant compressed in the low pressure compression assembly 120 is sucked into the high pressure compression assembly 130 through the mid-pressure chamber Pm defined in the lower bearing 161 and the connection pipe 180, compressed in the high pressure compression assembly 130 by the same process as in the low pressure compression assembly 120, and discharged to the inside of the hermetic container 101. That is, the mid-pressure refrigerant sucked through a high pressure inlet 136 is compressed in a high pressure cylinder 131 by a high pressure roller 133 eccentrically rotated by a high pressure eccentric portion 113*b*.

Figure 6:
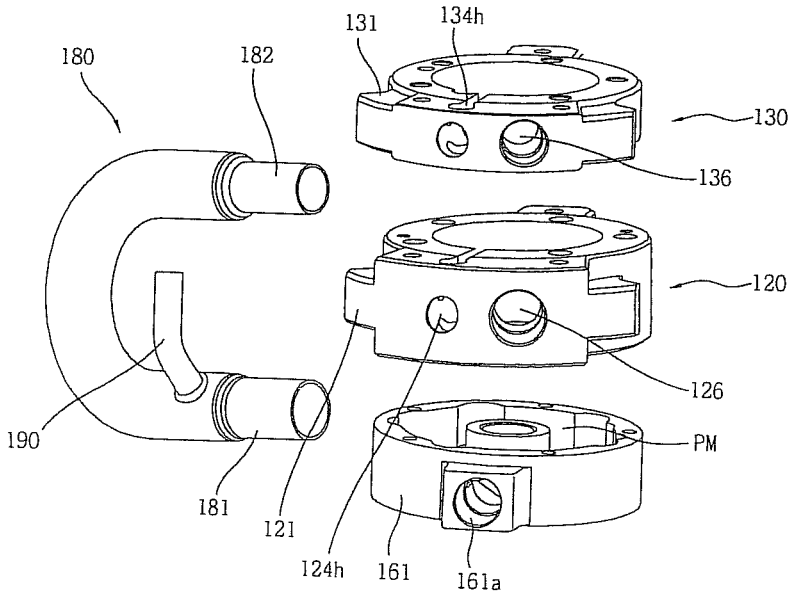
FIG. 6 is a view of a low pressure cylinder, a high pressure cylinder, a lower bearing, and a connection pipe according to the embodiment of the present invention.

FIG. 6 is a view of the low pressure cylinder, the high pressure cylinder, the lower bearing, and the connection pipe according to the embodiment of the present invention. As illustrated in FIG. 4, since the low pressure cylinder 121 and the high pressure cylinder 131 should be fixed to the inner surface of the hermetic container 101, they preferably have an outer diameter corresponding to the inner diameter of the hermetic container 101. Therefore, the low pressure cylinder 121 and the high pressure cylinder 131 have almost the same outer diameter. In addition, the low pressure cylinder 121 and the high pressure cylinder 131 have almost the same inner diameter. The low pressure roller 123 and the high pressure roller 133 are eccentrically rotated along the inner circumferences of the low pressure cylinder 121 and the high pressure cylinder 131 by the low pressure eccentric portion 113*a* and the high pressure eccentric portion 113*b* of the rotating shaft 113, respectively, thus compressing the refrigerant. Here, in order to prevent vibration and noise from being produced in the hermetic container 101 due to the weight unbalance of the low pressure roller 123, the high pressure roller 133, the low pressure eccentric portion 113*a*, and the high pressure eccentric portion 113*b*, the low pressure roller 123 and the low pressure eccentric portion 113*a* and the high pressure roller 133 and the high pressure eccentric portion 113*b* are generally located at an interval of 180°. The RPM of the low pressure roller 123 and the low pressure eccentric portion 113*a* is the same as the RPM of the high pressure roller 133 and the high pressure eccentric portion 113*b*. Accordingly, when the mass sum of the low pressure roller 123 and the low pressure eccentric portion 113*a* is set to be the same as the mass sum of the high pressure roller 133 and the high pressure eccentric portion 113*b*, it can be said that the centrifugal force acting on the low pressure roller 123 and the low pressure eccentric portion 113*a* and the centrifugal force acting on the high pressure roller 133 and the high pressure eccentric portion 113*b* are proportional to the outer diameter of the low pressure roller 123 and the outer diameter of the high pressure roller 133, i.e., the inner diameter of the low pressure cylinder 121 and the inner diameter of the high pressure cylinder 131. Here, when the centrifugal force exerted on the low pressure roller 123 and the low pressure eccentric portion 113*a* is the same as the centrifugal force exerted on the high pressure roller 133 and the high pressure eccentric portion 113*b*, the vibration of the compressor 100 can be minimized. It is thus advantageous that the inner diameter of the low pressure cylinder 121 should be the same as the inner diameter of the high pressure cylinder 131.

Therefore, since the inner diameter of the low pressure cylinder 121 is the same as the inner diameter of the high pressure cylinder 131 and the outer diameter of the low pressure roller 123 is the same as the outer diameter of the high pressure roller 133, it can be said that the volume of the compression space (stroke volume) defined in the low pressure cylinder 121 and the stroke volume defined in the high pressure cylinder 131 are proportional to the height of the low pressure cylinder 121 and the height of the high pressure cylinder 131, respectively.

Meanwhile, since the refrigerant primarily compressed in the low pressure compression assembly 120 is compressed again in the high pressure compression assembly 130, the stroke volume required in the high pressure compression assembly 130 is smaller than the stroke volume required in the low pressure compression assembly 120. As the mid-pressure gaseous refrigerant separated in the phase separator 500 (see FIG. 3) is further introduced through an injection pipe 190 connected to the connection pipe 180, the mass or mole number of the refrigerant compressed in one rotation is greater in the high pressure compression assembly 130, but the stroke volume is greater in the low pressure compression assembly 120. Here, when the ratio of the stroke volume V2 of the high pressure compression assembly 130 to the stroke volume V1 of the low pressure compression assembly 120 existed in the range of '$0.43<V2/V1<0.82$', the performance was good.

As described above, the ratio H2/H1 of the height H2 of the high pressure cylinder 131 to the height H1 of the low pressure cylinder 121 has almost the same value as the ratio of the stroke volume V2 of the high pressure compression assembly 130 to the stroke volume V1 of the low pressure compression assembly 120.

Alternatively, the low pressure cylinder 121 and the high pressure cylinder 131 may have the same height but different inner diameters, so that the volumes of the compression spaces (stroke volumes) can be different. However, so as to fix the low pressure cylinder 121 and the high pressure cylinder 131 to the hermetic container 101, the outer diameters of the low pressure cylinder 121 and the high pressure cylinder 131 should be almost the same as the inner diameter of the hermetic container 101. In this situation, the difference between the outer diameter and the inner diameter of the high pressure cylinder 131 increases, and thus the weight of the high pressure cylinder 131 increases, which leads to a high unit cost of production. Accordingly, in terms of the unit cost reduction and the weight reduction, it is advantageous that the low pressure cylinder 121 and the high pressure cylinder 131 should have the same inner and outer diameters and different heights to have different stroke volumes.

Moreover, the height of the low pressure roller 123 and the height of the high pressure roller 133 are the same as the height of the low pressure cylinder 121 and the height of the high pressure cylinder 131, respectively. With respect to the centrifugal force exerted by the low pressure roller 123 and the low pressure eccentric portion 113*a* and the centrifugal force exerted by the high pressure roller 133 and the high pressure eccentric portion 113*b*, not only the inner diameters and angular velocities of the low pressure cylinder 121 and the high pressure cylinder 131 but also the mass sum of the low pressure roller 123 and the low pressure eccentric portion 113*a* and the mass sum of the high pressure roller 133 and the high pressure eccentric portion 113*b* become variables. Therefore, the low pressure eccentric portion 113*a* and the high pressure eccentric portion 113*b* include contact portions which are brought into direct contact with the low pressure roller 123 and the high pressure roller 133, respectively, and non-contact portions which are not brought into contact therewith. In other words, not the whole but some parts of the low pressure eccentric portion 113*a* and the high pressure eccentric portion 113*b* are brought into contact with the low pressure roller 123 and the high pressure roller 133, respectively. If the sizes of the rest parts of the low pressure eccentric portion 113*a* and the high pressure eccentric portion 113*b* are reduced, the masses thereof are reduced, which makes it possible to reduce not the load generated by the compression of the refrigerant upon the driving of the motor but the load generated for the rotation of the eccentric portions 113*a* and 113*b*. Further, the centrifugal force produced by the low pressure eccentric portion 113*a* and the centrifugal force produced by the high pressure eccentric portion 113*b* are made to be the same by adjusting the height of the contact portion of the low pressure eccentric portion 113*a* and the height of the contact portion of the high pressure eccentric portion 113*b*, respectively, which makes it possible to reduce vibration and noise generated upon the driving of the compressor 100.

In the meantime, the compressor 100 includes the connection pipe 180 which has both ends inserted into the lower bearing 161 and the high pressure cylinder 131 respectively and which guides the refrigerant compressed in the low pressure compression assembly 120 to the high pressure compression assembly 130. Additionally, the connection pipe 180 serves to reduce the pulsation of the refrigerant, while guiding the mid-pressure refrigerant discharged from the low pressure compression assembly 120 to the high pressure compression assembly 130. The pulsation of the refrigerant occurs because the refrigerant is discontinuously discharged from the low pressure compression assembly 120. Moreover, the low pressure compression assembly 120 and the high pressure compression assembly 130 discharge the refrigerant respectively until a discharge valve (not shown) opened over a given pressure is closed again, and the opening of the discharge valve (not shown) occurs once per stroke (per rotation). On the contrary, as the volume of the inlet portion $S_1$ (see FIG. 5) increases in the low pressure cylinder 121 and the high pressure cylinder 131, a negative pressure is generated in the inlet portion $S_1$, so that the refrigerant is sucked into the low pressure compression assembly 120 and the high pressure compression assembly 130. Since the volume of the inlet portion $S_1$ continuously increases while the rollers 123 and 133 roll along the inner circumferences of the cylinders 121 and 131, the refrigerant is continuously sucked into the low pressure compression assembly 120 and the high pressure compression assembly 130. The refrigerant sucked into the low pressure compression assembly 120 has been stored in the accumulator 200. Therefore, when the refrigerant is sucked into the low pressure compression assembly 120, its pulsation is not severe. However, the refrigerant sucked into the high pressure compression assembly 130 has been primarily compressed in the low pressure compression assembly 120. The refrigerant can be sucked into the high pressure compression assembly 130 after discharged from the low pressure compression assembly 120. As the refrigerant is discontinuously discharged from the low pressure compression assembly 120, its pulsation is severe. The refrigerant discharged from the low pressure compression assembly 120 is temporarily stored in the mid-pressure chamber Pm defined in the lower bearing 161, and thus its pulsation is reduced to some extent. The larger the space for temporarily storing the mid-pressure refrigerant, the more effectively the pulsation of the refrigerant discharged from the low pressure compression assembly 120 can be reduced. However, the compressor 100 has limitations in size, and thus the mid-pressure chamber Pm defined in the lower bearing 161 has limitations in volume. That is, in order to increase the volume of the mid-pressure chamber Pm, it is essential to increase the length or inner and outer diameters of the lower bearing 161. Since the increase of the length or inner and outer diameters of the lower bearing 161 leads to the increase of the length or diameter of the hermetic container 101, the size of the compressor 100 itself is unnecessarily increased by a factor irrelevant to the compression capacity, which is inefficient in terms of space usage. According to another method for reducing the pulsation of the mid-pressure refrigerant discharged from the low pressure compression assembly 120 and allowing the refrigerant to be sucked into the high pressure compression assembly 130, in the 2-stage rotary compressor 100 of the present invention, the inner diameter of the connection pipe 180 is increased, and thus the volume thereof is increased, so that the inner space of the connection pipe 180 serves as a damping space for reducing the pulsation of the mid-pressure refrigerant. Here, since the compression capacities of the low pressure compression assembly 120 and the high pressure compression assembly 130 have been determined in advance according to the capacity of the compressor 100, the heights of the low pressure cylinder 121 and the high pressure cylinder 131 have been determined in advance. In addition, the size of the lower bearing 161 has been determined as a given size. However, the inner diameter of the connection pipe 180 cannot be increased irrespective of the heights of the low pressure cylinder 121 and the high pressure cylinder 131. Therefore, the connection pipe 180 provided in the 2-stage rotary compressor 100 of the present invention includes both end portions 181 and 182 having an inner diameter small enough to be inserted into the lower bearing 161 and the high pressure cylinder 131, respectively, and a middle portion 183 having a larger inner diameter than the both end portions 181 and 182. Accordingly, the connection pipe 180 can have a sufficient volume to be used as a space for reducing the pulsation of the mid-pressure refrigerant, irrespective of the heights of the low pressure cylinder 121, the high pressure cylinder 131, and the lower bearing 161. In the meantime, the inner diameters of the both end portions 181 and 182 should be determined in such a range that the peripheral portions of a mid-pressure communication hole 161*a* and a high pressure inlet 136 of the lower bearing 161 and the high pressure cylinder 131 can obtain a sufficient thickness to ensure operation reliability and that the inner diameters of the both end portions 181 and 182 can be increased to the utmost to reduce the pulsation of the refrigerant compressed to a mid-pressure.

For this purpose, the inner diameters of the both end portions 181 and 182 of the connection pipe 180 should have a size below a given ratio with respect to the heights of the lower bearing 161 and the high pressure cylinder 131 into which the both end portions 181 and 182 are to be inserted, respectively. It is preferable that the inner diameters Du of the both end portions 181 and 182 should have a value of $0.4<Du/H<0.85$ with respect to the heights H of the lower bearing 161 and the high pressure cylinder 131, respectively. If $0.4>Du/H$, the inner diameters Du of the both end portions 181 and 182 are too small. In this situation, when the refrigerant is introduced from the lower bearing 161 to the connection pipe 180 and sucked from the middle portion 183 to the end portion 182, the passage resistance increases, so that the refrigerant cannot be smoothly sucked and discharged. On the contrary, if $Du/H>0.85$, the inner diameters Du of the both end portions 181 and 182 are too large. In this situation, the thickness of the lower bearing 161 or the high pressure cylinder 131 around the both end portions 181 and 182 is reduced, so that the load may be concentrated by vibration or the like generated during the operation, causing damage. On the other hand, when the capacity of the compressor 100 is small such that the height of the lower bearing 161 or the high pressure cylinder 131 is low, it is preferable that at least Du<H-5 (mm), i.e., the inner diameters of the both end portions 181 and 182 should be at least 5 mm smaller than the height of the lower bearing 161 or the high pressure cylinder 131. Meanwhile, when the inner diameter of the injection pipe 190 connected to the connection pipe 180 increases, the injection amount of the gaseous refrigerant introduced from the phase separator 300 increases, which improves the coefficient of performance (COP). Therefore, preferably, the injection pipe 190 is connected to the middle portion 183 of the connection pipe 180 which has a large inner diameter.

In addition, the low pressure inlet 126 formed in the low pressure cylinder 121 and the mid-pressure communication hole 161*a* formed in the lower bearing 161 may be set to have about the same size. That is, it is preferable that the inner diameter of the refrigerant inlet pipe 151 inserted into the low pressure inlet 126 and the inner diameter of the low pressure-side end portion 181 of the connection pipe 180 should have about the same size. In this case, since the formation of the mid-pressure communication hole 161*a* and the low pressure inlet 126, the connection of the refrigerant inlet pipe 151, and the connection of the low pressure-side end portion 181 of the connection pipe 180 can be managed in the same manner, the manufacturing process can be simplified and the manufacturing costs can be cut down.

Figure 7:
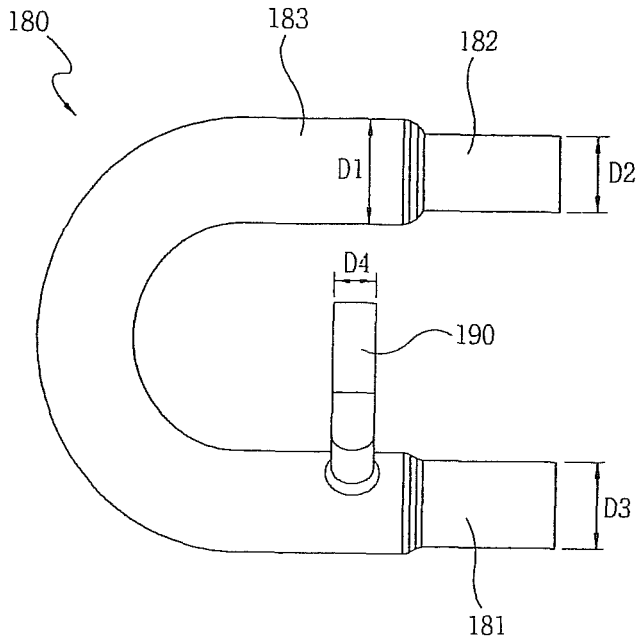
FIG. 7 is a view of the connection pipe provided in the 2-stage rotary compressor according to the embodiment of the present invention.
Figure 8:
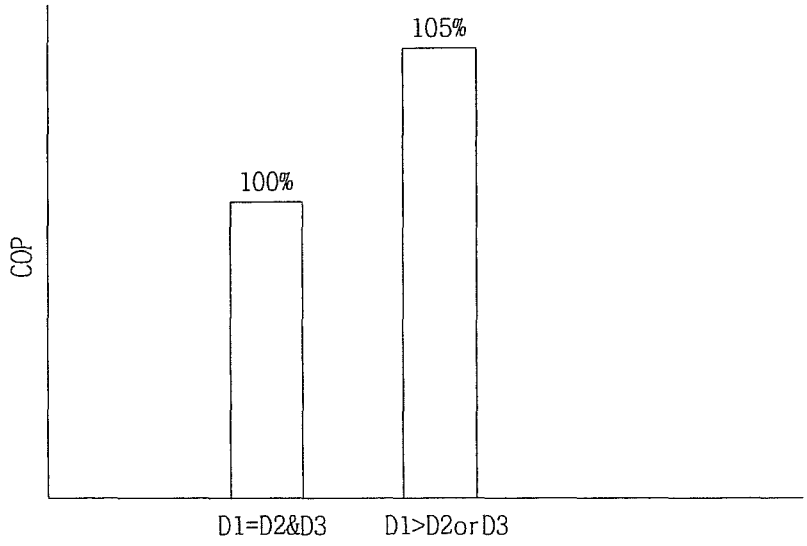
FIG. 8 is a graph showing an improvement of the COP achieved by increasing the inner diameter of a middle portion of the connection pipe according to the present invention.
Figure 9:
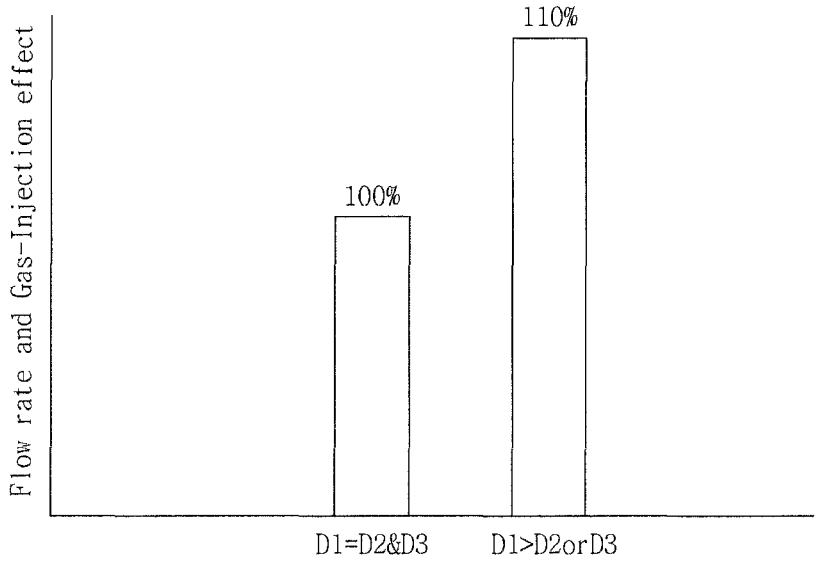
FIG. 9 is a graph showing changes in a suction flow rate of refrigerant and an amount of gaseous refrigerant injected through an injection pipe, which are caused by increasing the inner diameter of the middle portion of the connection pipe according to the present invention.

FIG. 7 is a view of the connection pipe provided in the 2-stage rotary compressor according to the embodiment of the present invention, FIG. 8 is a graph showing an improvement of the COP achieved by increasing the inner diameter of the middle portion of the connection pipe according to the present invention, and FIG. 9 is a graph showing changes in a suction flow rate of refrigerant and an amount of gaseous refrigerant injected through the injection pipe, which are caused by increasing the inner diameter of the middle portion of the connection pipe according to the present invention. In FIGS. 7 to 9, D1 represents the inner diameter of the middle portion 183 of the connection pipe 180, D2 represents the inner diameter of the high pressure-side end portion 182 connected to the high pressure cylinder 131, D3 represents the inner diameter of the low pressure-side end portion 181 connected to the lower bearing 161, and D4 represents the inner diameter of the injection pipe 190. Referring to FIG. 8, if the COP of the compressor 100 was 100% when the inner diameters of the connection pipe 180 were the same, regardless of the middle portion 183 and the both end portions 181 and 182, the COP was 105%, i.e., was increased by about 5% when the inner diameter D1 of the middle portion 183 was greater than the inner diameters D3 and D2 of the both end portions 181 and 182 according to the present invention. Additionally, referring to FIG. 9, with respect to the flow rate of the refrigerant flowing in the connection pipe 180 including the flow rate of the refrigerant introduced into the connection pipe 180 through the injection pipe 190, if the flow rate was 100% when the inner diameters of the connection pipe 180 were constant (D1=D2=D3), the flow rate was increased to 110% when the inner diameter D1 of the middle portion 183 was greater than the inner diameters D3 and D2 of the both end portions 181 and 182 (D1>D2, D3), i.e., the flow rate of the refrigerant flowing in the connection pipe 180 was increased by about 10%. The flow rate of the refrigerant flowing in the connection pipe 180 is the flow rate of the refrigerant sucked into the high pressure compression assembly 130. When the amount of the refrigerant compressed in the high pressure compression assembly 130 increases and the COP rises, the refrigerating capacity is improved. Moreover, the increased volume of the connection pipe 180 serves as a damper reducing the pressure pulsation and serves to reduce the over-compression loss in the low pressure compression assembly 120. In other words, the pressure pulsation and the over-compression loss can be reduced, and thus the vibration and noise can be suppressed, which brings about the improvement of the compressor.

The invention claimed is:

1. A 2-stage rotary compressor, comprising:

a hermetic container;

a rotating shaft provided in the hermetic container, that transfers a rotational force;

a low pressure compression assembly including a low pressure roller eccentrically rotated around a center of the rotating shaft, a low pressure cylinder that accommodates the low pressure roller, and a low pressure vane that partitions an inner space of the low pressure cylinder;

a high pressure compression assembly including a high pressure roller eccentrically rotated around the center of the rotating shaft, a high pressure cylinder that accommodates the high pressure roller, and a high pressure vane that partitions an inner space of the high pressure cylinder;

a connection pipe that provides a passage for the refrigerant compressed in the low pressure compression assembly to be introduced into the high pressure compression assembly; and an injection pipe connected to the connection pipe, wherein a ratio of a stroke volume V2 of the high pressure cylinder to a stroke volume V1 of the low pressure cylinder satisfies the relational expression of 0.43<V2/V1<0.82, and wherein an inner diameter of a middle portion of the connection pipe is greater than inner diameters of both end portions of the connection pipe.

2. The 2-stage rotary compressor of claim 1, wherein the rotating shaft comprises a low pressure eccentric portion in a position eccentric with respect to the center of the rotating shaft, wherein the low pressure eccentric portion comprises a contact portion which is brought into contact with an inner circumferential surface of the low pressure roller and a non-contact portion which is not brought into contact with the inner circumferential surface of the low pressure roller, and wherein a height of the contact portion of the low pressure eccentric portion is equal to or smaller than 70% of a height of the low pressure roller.

3. The 2-stage rotary compressor of claim 1, wherein the rotating shaft comprises a high pressure eccentric portion in a position eccentric with respect to the center of the rotating shaft, wherein the high pressure eccentric portion comprises a contact portion which is brought into contact with an inner circumferential surface of the high pressure roller and a non-contact portion which is not brought into contact with the inner circumferential surface of the high pressure roller, and wherein a height of the contact portion of the high pressure eccentric portion is equal to or greater than 70% of a height of the high pressure roller.

4. The 2-stage rotary compressor of claim 1, wherein a mass sum of the low pressure roller and a low pressure eccentric portion of the rotating shaft is the same as a mass sum of the high pressure roller and a high pressure eccentric portion of the rotating shaft.

5. A 2-stage rotary compressor, comprising:

a hermetic container;

a rotating shaft provided in the hermetic container, that transfers a rotational force;

a low pressure compression assembly including a low pressure roller eccentrically rotated around a center of the rotating shaft, a low pressure cylinder that accommodates the low pressure roller, and a low pressure vane that partitions an inner space of the low pressure cylinder;

a high pressure compression assembly including a high pressure roller eccentrically rotated around the center of the rotating shaft, a high pressure cylinder that accommodates the high pressure roller, and a high pressure vane that partitions an inner space of the high pressure cylinder;

a connection pipe that provides a passage for the refrigerant compressed in the low pressure compression assembly to be introduced into the high pressure compression assembly; and an injection pipe connected to the connection pipe, wherein a stroke volume V2 of the high pressure cylinder is smaller than a stroke volume V1 of the low pressure cylinder, and wherein an inner diameter of a middle portion of the connection pipe is greater than inner diameters of both end portions of the connection pipe.

6. The 2-stage rotary compressor of claim 5, further comprising a mid-pressure chamber that temporarily stores the refrigerant compressed in and discharged from the low pressure compression assembly, wherein one end portion of the connection pipe is connected to the mid-pressure chamber and the other end portion thereof is connected to the high pressure cylinder.

7. The 2-stage rotary compressor of claim 6, wherein an inner diameter Du of a high pressure-side end portion of the connection pipe and a height H of the high pressure cylinder satisfy the relational expression of $0.4<Du/H<0.85$.

8. The 2-stage rotary compressor of claim 6, wherein an inner diameter of a high pressure-side end portion of the connection pipe is at least 5 mm smaller than a height of a high pressure cylinder.

9. The 2-stage rotary compressor of claim 6, wherein the mid-pressure chamber is defined in a lower bearing, and an inner diameter Du of a low pressure-side end portion of the connection pipe and a height H of the lower bearing satisfy the relational expression of $0.4<Du/H<0.85$.

10. The 2-stage rotary compressor of claim 6, wherein the mid-pressure chamber is defined in a lower bearing, and an inner diameter of a low pressure-side end portion of the connection pipe is at least 5 mm smaller than the height of the lower bearing.

11. The 2-stage rotary compressor of claim 5, wherein the low pressure cylinder further comprises a refrigerant inlet pipe through which low pressure refrigerant is sucked, and wherein an inner diameter of the refrigerant inlet pipe is about the same as an inner diameter of a low-pressure side end portion of the connection pipe.

12. The 2-stage rotary compressor of claim 5, wherein the injection pipe is connected to the middle portion of the connection pipe which has a larger inner diameter than both end portions of the connection pipe.

13. The 2-stage rotary compressor of claim 12, wherein the injection pipe is connected in closer proximity to a low pressure-side end portion of the connection pipe than a high pressure-side end portion of the connection pipe.

14. The 2-stage rotary compressor of claim 5, wherein the rotating shaft comprises a low pressure eccentric portion in a position eccentric with respect to the center of the rotating shaft, wherein the low pressure eccentric portion comprises a contact portion which is brought into contact with an inner circumferential surface of the low pressure roller and a non-contact portion which is not brought into contact with the inner circumferential surface of the low pressure roller, and wherein a height of the contact portion of the low pressure eccentric portion is equal to or smaller than 70% of a height of the low pressure roller.

15. The 2-stage rotary compressor of claim 5, wherein the rotating shaft comprises a high pressure eccentric portion in a position eccentric with respect to the center of the rotating shaft, wherein the high pressure eccentric portion comprises a contact portion which is brought into contact with an inner circumferential surface of the high pressure roller and a non-contact portion which is not brought into contact with the inner circumferential surface of the high pressure roller, and wherein a height of the contact portion of the high pressure eccentric portion is equal to or greater than 70% of a height of the high pressure roller.

16. The 2-stage rotary compressor of claim 5, wherein a mass sum of the low pressure roller and a low pressure eccentric portion of the rotating shaft is the same as a mass sum of the high pressure roller and a high pressure eccentric portion of the rotating shaft.

* * * * *